United States Patent [19]

Greskovich et al.

[11] 4,272,501

[45] Jun. 9, 1981

[54] CARBON FIBERS FROM SRC PITCH

[75] Inventors: Eugene J. Greskovich, Allentown; Edwin N. Givens, Bethlehem, both of Pa.

[73] Assignee: International Coal Refining Company, Allentown, Pa.

[21] Appl. No.: 126,499

[22] Filed: Mar. 3, 1980

[51] Int. Cl.[3] ..... D01F 9/14

[52] U.S. Cl. ..... 423/447.1; 208/8 LE; 264/29.2; 423/447.4; 423/447.6

[58] Field of Search ..... 423/447.1, 447.2, 447.4, 423/447.6; 264/29.2; 208/8 LE, 45

[56] References Cited

U.S. PATENT DOCUMENTS 4,146,576 3/1979 Wyss ..... 423/447.4

FOREIGN PATENT DOCUMENTS 51-75126 6/1976 Japan ..... 264/29.2

1315940 5/1973 United Kingdom ..... 423/447.1

OTHER PUBLICATIONS

"The Engineer" Jul. 2, 1970, pp. 30+31.

*Primary Examiner*—Edward J. Meros

*Attorney, Agent, or Firm*—Russell L. Brewer; E. Eugene Innis

[57] ABSTRACT

This invention relates to an improved method of manufacturing carbon fibers from a coal derived pitch. The improvement resides in the use of a solvent refined coal which has been hydrotreated and subjected to solvent extraction whereby the hetero atom content in the resulting product is less than 4.0% by weight and the softening point is between about 100°-250° F.

4 Claims, 1 Drawing Figure

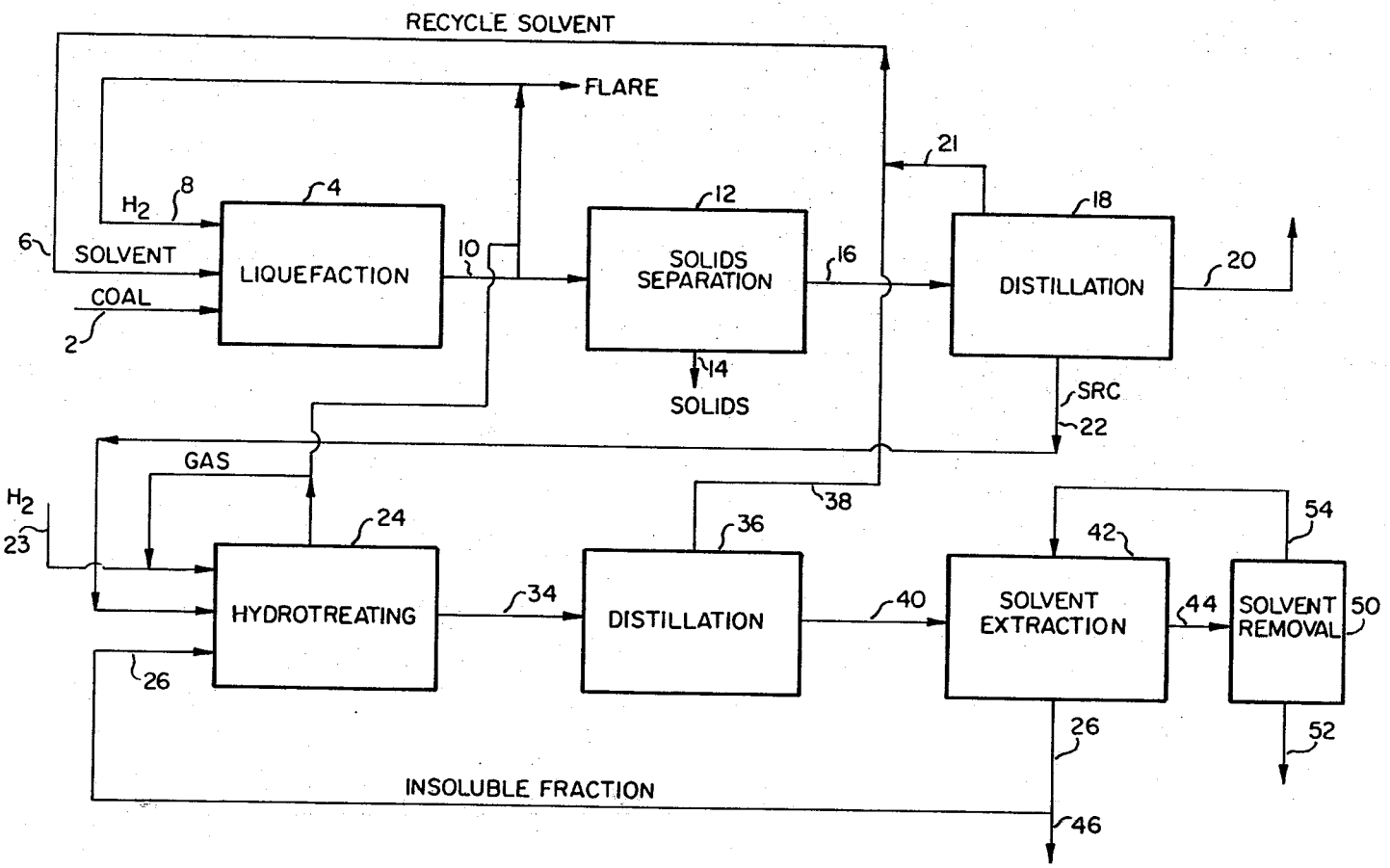
RECYCLE SOLVENT
FLARE
LIQUEFACTION
4
10
SOLIDS SEPARATION
12
14
SOLIDS
16
DISTILLATION
18
20
21
SRC
22
8
$H_2$
SOLVENT
COAL
2
6
GAS
HYDROTREATING
24
34
DISTILLATION
36
38
40
SOLVENT EXTRACTION
42
44
SOLVENT REMOVAL
50
52
54
26
46
INSOLUBLE FRACTION
26
$H_2$
23

CARBON FIBERS FROM SRC PITCH

DESCRIPTION OF THE PRIOR ART

The manufacture of carbon fibers and filaments from various carbonaceous materials is widely reported in the literature. The process steps generally used for forming a fiber or filament include:

spinning a fiber from a pitch material;

heating the fiber form in the presence of oxygen to a temperature of at least 250° C. for about 2 to 4 hours to effect infusibility or thermosetting of the pitch material; and then heating the thermoset or fusible material to a temperature of about 1,000°–2,500° C. in the presence of an inert atmosphere to effect carbonizing or graphitizing.

A variety of carbonaceous materials have been used in forming carbon fibers. These carbonaceous materials include coal-tar pitches, petroleum pitches and those obtained from the destructive heating of various polymers, e.g. polyacrylates and polyacrylonitrile.

Coal-tar pitches generally have been obtained by the destructive distillation of coal. Such pitches, although suited for carbon fiber manufacture have a number of process disadvantages. Because these pitches are produced as a byproduct from metallurgical coke production the quality of these materials often vary. Any variation in softening point causes changes in ultimate fiber quality due to the performance of the pitch during the thermosetting step. It is well known that as the softening point diminishes, the oxidation must be carried out at successively lower temperatures. As a result long oxidation cycles are required.

In contrast, the process of the present invention permits the manufacture of a carbonaceous form (solvent refined coal; SRC) from a coal derived source which is well suited for the manufacture of carbon fibers. The carbon material obtained by the process has a low hetero atom content and a reduced preasphaltene content and these properties can be easily controllable. This reduced preasphaltene content permits the formation of a mesophase like pitch, which results in the production of highly-oriented fibers. The inherent capability of the process of this invention to maintain a constant high quality pitch will result in improved fiber quality control. In addition, pitches having a wide range of softening points can be produced.

SUMMARY OF THE INVENTION

This invention relates to a process for manufacturing carbon fibers from a solvent refined coal originally containing a substantial proportion of insolubles and hetero atoms, e.g. oxygen, nitrogen and sulfur. The invention resides in converting the SRC to a carbonaceous form which is well suited for carbon fiber manufacture. The process comprises:

(a) hydrotreating the solvent refined coal in the presence of a hydrogenation catalyst suited to reduce the hetero atom content but restricting hydrotreating to a level insufficient to convert more than 25% of the solvent refined coal to a form having a boiling point less than 850° F. thereby forming a major fraction having a normal boiling point of greater than 850° F.;

(b) distilling the hydrotreated solvent refined coal to remove volatiles therefrom thereby leaving a heavy fraction having a boiling point of greater than about 850° F.;

(c) removing the heavy fraction formed in step (b) and subjecting that fraction to solvent extraction in an extraction zone, said solvent extraction effecting solubilization of a portion of the solvent refined coal;

(d) removing the solubilized solvent refined coal from the extraction zone; and (f) removing the solvent therefrom to form a carbonaceous fraction suited for fiber manufacture.

THE DRAWING

The FIGURE represents a process flow diagram showing the introduction of coal to the process and the subsequent recovery of a carbonaceous fraction as the final step.

DESCRIPTION OF THE PREFERRED EMBODIMENTS

Referring to the drawing, coal which has been converted to a particle form (from minus 20 to 0 mesh screen U.S. Standard), is introduced through line 2 to liquefaction zone 4. A hydrogen donor solvent is conveyed to zone 4 by line 6 and hydrogen through line 8. Liquefaction is carried out in the absence of a hydrogenation catalyst in conventional manner.

During liquefaction the coal is hydrogenated producing a gaseous stream, which contains some ammonia, (by virtue of decomposition of the nitrogen compounds), hydrogen sulfide, methane, unreacted hydrogen and a coal liquid extract. The extract which is dissolved in the hydrogen donor solvent is comprised of a tar-like residue having a boiling point of 750° F.+ (and heavies having a boiling point of 1,000+) which must be hydrogenated further.

Examples of hydrogen donor solvents suitable for liquefaction include tetrahydronaphthalene, partially hydrogenated phenanthrenes or creosote oil. In the process, these solvents are internally generated in hydrotreating zone 24 and/or the liquefaction zone 4.

After liquefaction of the coal in zone 4, the liquid coal, ash, etc., carried in the solvent is removed via line 10 to a solids separation zone 12. In this zone the insoluble material, namely ash and unconverted insoluble coal, is removed via conventional manner. Typically, solid separation is effected by filtration or by the use of a solvent technique. The latter process is known as the Critical Solvent Deashing process and is described in U.S. Pat. Nos. 4,162,956; 4,153,538; 4,119,524 and 4,162,964 and is incorporated by reference. In a solvent deashing technique, the distillation zone 18 will precede the solid separation zone 12.

The ash and solid fraction from solid separation zone 12 is removed via line 14 for disposal or is used as feed to an oxygen or air blown gasifier for generation of hydrogen. The coal liquid extract is removed via line 16 and is introduced to a distillation zone 18. The coal liquid, which includes process solvent, is fractionated in essentially three components, one being a light gasoline fraction having a boiling point not greater than about 450° F. at atmospheric pressure, the second being the 450°–850° F. recycle solvent and the other being a heavy SRC fraction. The solvent refined coal (SRC) fraction typically has a boiling point in excess of 850° F. at atmospheric pressure. The light fraction is obtained from distillation zone 18 via line 20 while the recycle solvent via line 21 and the SRC or solid fraction is obtained through line 22. Because the fluidity of material from zone 18 via line 22 must be adequate for handling purposes, the upper cut point of the recycle solvent can be lowered to 650°–850° F.

The SRC from line 22 constitutes the feedstock for the subsequent operations in the production of the carbonaceous fraction. The first step in the processing of the SRC involves hydrotreating the SRC in hydrotreating zone 24. Hydrotreating is carried out to reduce the hetero atom content and to crack some of the non-distillables, i.e., those having a boiling point over 850° +F., especially those over 1000° F. including the preasphaltenes. The hydrotreating is carried out at temperatures of from 680°–950° F. at pressures of 1,000–6,000 psig and a hydrogen feed rate through line 23 of 600–12,000 standard cubic feet per barrel of oil produced. The ratio of solvent having a boiling point less than 750° F. to SRC in the feedstock can range from 0.1 to 3:1 and preferably 0.2 to 2:1 by weight. Where the ratio exceeds about 3:1 some of the solvent can be converted to lower boiling material and represents a loss of hydrogen.

The severity of hydrotreating should be carefully controlled in zone 24 to reduce the hetero atom content in the form of combined N, O and sulfur. Heteroatom content in line 34 normally will not exceed about 5% by weight after hydrogenation. On the other hand hydrotreating can be too exhaustive (too high in severity) and then too much of the carbonaceous material is converted to low molecular weight material thus making it unsuited as a feedstock for carbon fiber production. Generally, severity is directly related to the softening point of the pitch produced. Typically in the hydrotreating step the combined hetero atom content in the SRC feedstock will be from about 5 to 7% by weight.

Often the hydrotreating techniques employ a fixed catalyst bed reaction zone or an ebullating bed. Representative processes are shown in U.S. Pat. Nos. 3,514,394; 3,607,719 and 3,519,553 and are incorporated by reference.

The product from the hydrotreating step is withdrawn through line 34 and subjected to distillation in distillation zone 36. In distillation zone 36 a light fraction is withdrawn as overhead through line 38 while the heavies are withdrawn through line 40. All or part of the light fraction in line 38 can be fed to the liquefaction zone as shown or to the hydrotreating zone 24 (not shown) to control the fluidity of the SRC in line 22 to the hydrotreating zone 24. Distillation is accomplished by various techniques using conventional distillation apparatus with the separation being suited to remove lights having an upper boiling point of 750° F., and preferably 850° F. at atmospheric pressure from the heavies. The heavies fraction in line 40 will have a boiling point in the neighborhood of 750° F. to 1200° F. at atmospheric pressure.

Solvent extraction of the heavies is carried out in the solvent extraction zone 42. The primary purpose is to extract the soluble fraction in the heavies. A secondary purpose is to reduce the hetero atom content to less than 4% by weight if this were not done in the hydrotreating stage. The third is to reduce the preasphaltene content. This soluble fraction is withdrawn through line 44 from the solvent extraction zone 42 and the insoluble fraction including preasphaltenes is recycled to hydrotreating zone 24 through line 26.

In the solvent extraction zone 42 the heavies, which are introduced through line 40, are slurried with a solvent under conditions such that intimate contact between the solvent and the heavies is effected. As stated, solvent extraction is carried out to dissolve the extractable portion of the heavies which is removed as eluent from the insoluble portion while the insoluble fraction is removed as raffinate through line 26. The extract contains the product necessary for carbon fiber manufacture.

Solvent extraction can be carried out using conventional techniques, e.g. packed bed columns using conventional packing material, sieve trays, baffle trays, etc. Solvents suited for extraction are of the type conventionally used for extracting petroleum pitches and may be a single component or mixture. These solvents generally include hydrocarbons of paraffin and cyclic composition, e.g. $C_5$ to $C_{10}$ aliphatic hydrocarbon solvents and $C_{6-10}$ aromatic solvents. Examples of suitable solvents include heptane, hexane, octane, nonane; cyclohexane; benzene, toluene, xylene and napththenic solvents; ether type solvents which include tetrahydrofuran, anisole; chlorinated aliphatic hydrocarbon e.g., chloroform, trichloroethylene, methylene chloride; having from 2–4 carbon atoms aliphatic and cyclic alcohols 1–8 carbon atoms such as methanol, ethanol, propanol, cyclohexanol; and ketonic or cyclic aldehydes such as cyclohexanone, benzaldehyde and others. The exact choice of solvent or solvents and degree of solvent extraction is dictated by the softening point of the extractable material and by the degree of hetero atom removal required. Softening points for the treated SRC typically is between 100°–250° F. In most cases, the preferred solvent for practicing this invention are hydrocarbons (paraffins, cycloparaffins, or aromatics) or chlorinated hydrocarbons.

In carbon fiber manufacture, the combined hetero atom content should be less than 4% by weight and generally from 2.5% to 3.8%. The product from the hydrotreating step will generally have a hetero atom concentration slightly higher than 4% because hetero atom reduction much below these levels may be too severe and result in producing an unsuitable carbonaceous component. In practice, solvent extraction may then be used to reduce the hetero atom content to acceptable levels. Hetero atom concentration is measured after the product is removed through line 44 from the extraction zone. The conditions are then adjusted in the solvent extraction to achieve the required reduction in hetero atom concentration. Generally, the greater affinity of the solvent for the extractable portion the greater the ability to remove the hetero atom material as the hetero atom material is contained in the insoluble fraction.

After solvent extraction the eluent from line 44 then is distilled in zone 50 to remove the solvent from the carbon product. This product in line 52 becomes the feedstock for carbon fiber manufacture. Solvent removal generally is effected in a distillation zone 50 with the distillation being done over a wide pressure range, e.g. from 1 millimeter to 100 atmospheres, but generally at atmospheric pressure. The solvent then can be recycled to the extraction zone 42 by way of line 54 or used elsewhere in the process.

The following examples are provided to illustrate preferred embodiments of the invention and are not intended to restrict the scope thereof.

EXAMPLE 1

An SRC containing filtrate in line 22 was obtained in conventional manner and was used as the feed for the runs to be described.

Hydrotreating of the filtrate was carried out in a tubular reactor having an inside diameter of 2 inches and a length of 60 inches. A ⅜ inch thermowell was inserted axially through the reactor and used for monitoring temperatures and pressures. The catalyst used for hydrogenation of the SRC containing filtrate was a commercial cobalt-molybdenum (3% CO, 15% MoO), supported on silica and stabilized with alumina. The catalyst was in the form of an extrudate having a dimension of ⅛ inch by ⅛ inch and had a surface area of 180 $m^2$ per gram. The reactor was filled with tab alumina as a bottom layer of about 25 inches followed by a layer of the catalyst providing a bed depth of about 30 inches with a top portion of about 5 inches of tab alumina. Feed including hydrogen was introduced at the bottom of the reactor and passed upflow through the reactor under various conditions.

Table 1 below provides the results for several hydrotreating runs operated at various conditions, e.g. temperature, LHSV, hydrogen feed rate, etc.

TABLE 1

| Run Number | Feed | 1 | 2 | 3 | 4 | 5 | 6 | 7 | 8 | 9 |
|---|---|---|---|---|---|---|---|---|---|---|
| Temperature °F. | — | 650 | 705 | 750 | 750 | 750 | 745 | 750 | 750 | 750 |
| Pressue psig | — | 2000 | 2000 | 2000 | 2000 | 2000 | 2000 | 2000 | 2000 | 2000 |
| LHSV | — | 1.0 | 1.0 | 0.7 | 1.0 | 0.3 | 0.9 | 1.6 | 1.6 | 0.7 |
| Hydrogen Feed Rate SCF/BBL | — | 2100 | 2200 | 3100 | 2400 | 7400 | 2400 | 1500 | 1400 | 4700 |
| Hydrogen Consumption SCF/BBL | — | 150 | 540 | 570 | 650 | 1080 | 580 | 720 | 620 | 650 |
| % Feed Hydrogen Consumed | — | 7 | 24 | 18 | 27 | 14 | 24 | 47 | 44 | 14 |
| Chemical Analyses, wt % | | | | | | | | | | |
| C | 86.8 | 87.8 | 88.2 | | | 86.8 | | | 87.2 | 87.3 |
| H | 7.5 | 8.1 | 8.7 | | | 9.7 | | | 8.5 | 8.9 |
| N | 1.10 | 1.04 | 0.96 | | | 0.8 | | | 1.03 | 0.99 |
| S | 0.53 | 0.32 | 0.16 | | | 0.07 | | | 0.14 | 0.09 |
| O | 4.0 | 2.8 | 1.9 | | | 2.7 | | | 3.2 | 3.27 |
| Benzene Insolubles, wt % | 9.4 | 2.0 | 4.1 | 1.7 | 2.1 | 1.0 | 1.8 | 2.6 | 3.1 | 3.4 |
| Heptane Insolubles, wt % | 16.4 | 13.2 | 9.8 | 5.0 | 6.3 | 4.0 | 7.2 | 9.2 | 9.4 | 6.5 |
| Product Distribution (wt %) | | | | | | | | | | |
| IBP-420° F. | — | 7.7 | 3.1 | 6.3 | 8.1 | 5.9 | 7.8 | 4.8 | 5.5 | 4.8 |
| 420–750° F. | 71.6 | 60.5 | 69.1 | 63.7 | 62.1 | 74.2 | 65.8 | 64.5 | 63.3 | 68.5 |
| 750+° F. | 28.4 | 31.4 | 26.3 | 27.5 | 26.9 | 18.5 | 24.4 | 26.3 | 29.2 | 24.7 |
| SRC Converted (wt %) (750° F.) | — | −8.0 | 7.9 | 3.7 | 5.8 | 35.4 | 18.3 | 8.0 | −2.3 | 13.5 |

Using this feedstock, it was possible in all cases to reduce the hetero atom content to about 4.0% by weight. It appears sulfur and nitrogen are more easily reduced than oxygen in view of the fact that as the proportion of 750° F.+ is reduced, the greater reduction in sulfur and nitrogen. A combination of solvent extraction with less severe hydrotreating, e.g. in Run 5, would appear desirable as it would result in lower conversion of SRC to volatile material.

EXAMPLE 2

Solvent extraction was performed by placing the solid untreated SRC material of Example 1 in a porous vessel and leaching the soluble fraction from the insoluble fraction by pouring the solvent over the SRC material. The filtrate was recovered and solvent was removed via distillation. The remaining solid pitch product was then analyzed.

Table 2 below represents the results for several solvents in terms of their ability to extract heteroatoms from the pitch.

TABLE 2

| Solvent | Extracting Time (hrs) | Softening Point °F. | Percent Heteratom Removal S | O | N |
|---|---|---|---|---|---|
| Cyclohexane | 144 | — | (1) | (1) | (1) |
| MeOH | 122 | N.A. | 10 | 9 | 25 |
| Benzene | 55 | 218 | 7 | 16 | 25 |
| Benzene | 110 | 222 | 4 | 16 | 28 |
| Methylene Chloride | 116 | N.A. | 4 | 20 | 28 |
| Chloroform | 96 | 261 | 11 | 17 | 27 |
| Tetrahydrofuran | 90 | 317 | 11 | 8 | 16 |

N.A. = not available

From the above data it can be concluded that benzene and methylene chloride are well suited for the removal of oxygen while chloroform and tetrahydrofuran are well suited for the removal of sulfur containing materials. If the analysis of the product obtained after a distillation shows high concentration of oxygen, it may be desirable to use methylene chloride. On the other hand the combination of methylene chloride and chloroform may be used where the material has high concentration of sulfur and oxygen. It is also observed from the table that the softening point of the resulting pitch can be adjusted from a high of 317° F. to a low of 218° F. by the use of those solvents. The use of an aromatic solvent, namely benzene, can result in producing a pitch having lower softening point while the chloroform and tetrahydrofuran solvents produce a material having a higher softening point. In practice then one can select a solvent to selectively remove heteroatom and simultaneously provide for a material having a desired softening point or a material having a softening point within a given range.

EXAMPLE 3

Two heavy fractions of hydrotreated and subsequently distilled SRC were treated with benzene in a manner described in Example 2. The solvent was removed and the solid product analyzed. The analyses of the heavy fractions and the extract are as follows:

TABLE 4

| Elemental Analyses | Heavy Fraction Feed to Solvent Extraction Unit | | Extract Product (Solvent Free Basis) | |
|---|---|---|---|---|
| | Run 1 | Run 2 | Run 1 | Run 2 |
| Carbon | 89.1 | 88.2 | 89.0 | 87.7 |
| Hydrogen | 7.06 | 6.67 | 7.2 | 7.0 |
| Nitrogen | 1.42 | 1.56 | 1.2 | 1.0 |
| Sulfur | 0.21 | 0.36 | 0.2 | 0.3 |
| Oxygen | 3.08 | 3.21 | 2.4 | 2.5 |
| Ash | NA | NA | — | — |
| Moisture | — | — | — | — |
| Softening Point | 160 | 187 | 136 | 144 |
| Ramsbottom Carbons | 32.4 | 36.1 | — | — |
| Benzene Soluble | 88 | 96 | 100 | 100 |

The runs show that the benzene extraction coupled with the hydrotreatment can reduce the heteroatom content from a value of about 7.5% to less than 4% by weight. As a result of this combination of hydrotreating and extraction, a pitch material is obtained which then produces a highly desirable carbon fiber.

What is claimed is:

1. In a process for manufacturing a carbon fiber from a coal derived pitch, the improvement which comprises utilizing as said coal derived pitch a solvent refined coal containing hetero atoms and a soluble and insoluble portion therein which has been treated in accordance with the following process steps:

(a) hydrotreating the solvent refined coal in the presence of a catalyst under conditions suited to reduce the heteroatom content but insufficient to convert more than 25% of the solvent refined coal to a fraction having a boiling point less than 850° F.;

(b) distilling the fraction generated in the hydrotreating step (a) under conditions suitable for removing volatiles therefrom leaving a heavy fraction having a boiling point of greater than 850° F.;

(c) subjecting the heavy fraction from step (b) to solvent extraction, said solvent extraction being effective for extracting the soluble portion of the solvent refined coal and reducing the total hetero atom content of the solubilized portion to less than 4% by weight; and (d) recovering the mixture of the soluble portion and solvent from the solvent extraction step and removing the solvent therefrom to form an SRC pitch.

2. The process of claim 1 wherein said hydrotreating is insufficient to convert more than 10% of the solvent refined coal to a boiling point less than 850° F.

3. The process of claim 2 wherein said SRC pitch has a total hetero atom content of from 2.5–3.8%.

4. The process of claim 3 wherein said solvent in step (c) is selected from the group consisting of $C_{5-10}$ aliphatic hydrocarbon, $C_{6-10}$ aromatic, chlorinated aliphatic hydrocarbon, $C_{1-8}$ aliphatic or cyclic alcohols, cyclohexanone and benzaldehyde.

* * * * *

UNITED STATES PATENT AND TRADEMARK OFFICE

CERTIFICATE OF CORRECTION

PATENT NO. : 4,272,501

DATED : Jun. 9, 1981

INVENTOR(S) : Greskovich et al.

It is certified that error appears in the above-identified patent and that said Letters Patent are hereby corrected as shown below:

Column 4, line 17: Delete "napththenic" and insert in its place -- naphthenic --.

Signed and Sealed this

*Twenth-eighth* Day of *September 1982*

[SEAL]

*Attest:*

GERALD J. MOSSINGHOFF

*Attesting Officer*

*Commissioner of Patents and Trademarks*